US006830377B2

(12) United States Patent
Schneider

(10) Patent No.: US 6,830,377 B2
(45) Date of Patent: Dec. 14, 2004

(54) RECLOSABLE PACKAGING WITH GAS BARRIER INCORPORATED IN ZIPPER

(75) Inventor: John H. Schneider, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 29 days.

(21) Appl. No.: 10/158,539

(22) Filed: May 30, 2002

(65) Prior Publication Data

US 2003/0223652 A1 Dec. 4, 2003

(51) Int. Cl.[7] ..... B65D 33/14

(52) U.S. Cl. ..... 383/5; 383/61.2; 383/203; 383/64

(58) Field of Search ..... 383/61.2, 5, 203, 383/63, 64

(56) References Cited

U.S. PATENT DOCUMENTS

| | | | | | |
|---|---|---|---|---|---|
| 4,925,316 | A | * | 5/1990 | Van Erden et al. | 383/210.1 |
| 4,949,527 | A | * | 8/1990 | Boeckmann et al. | 53/412 |
| 5,022,530 | A | * | 6/1991 | Zieke | 383/204 |
| 5,063,069 | A | * | 11/1991 | Van Erden et al. | 426/122 |
| 5,121,997 | A | * | 6/1992 | La Pierre et al. | 383/203 |
| 5,774,954 | A | * | 7/1998 | Ramsey et al. | 24/585.1 |
| 6,152,601 | A | * | 11/2000 | Johnson | 383/210 |
| 6,183,134 | B1 | * | 2/2001 | Malin | 383/210 |
| 6,224,262 | B1 | * | 5/2001 | Hogan et al. | 383/203 |
| 6,273,607 | B1 | * | 8/2001 | Buchman | 383/5 |
| 6,290,393 | B1 | * | 9/2001 | Tomic | 383/210.1 |
| 6,354,738 | B1 | * | 3/2002 | Buckman et al. | 383/5 |
| 6,360,513 | B1 | * | 3/2002 | Strand et al. | 53/412 |
| 6,499,878 | B1 | * | 12/2002 | Dobreski et al. | 383/5 |
| 6,659,643 | B2 | * | 12/2003 | Plourde et al. | 383/61.2 |

FOREIGN PATENT DOCUMENTS

| | | | | |
|---|---|---|---|---|
| EP | 000528721 A | * | 2/1993 | 383/63 |
| FR | 1.551.228 | * | 11/1968 | 383/64 |
| WO | WO 00/68104 | | 11/2000 | |
| WO | WO 01/46028 | | 6/2001 | |

* cited by examiner

*Primary Examiner*—Jes F. Pascua
(74) *Attorney, Agent, or Firm*—Ostrager Chong Flaherty & Broitman P.C.

(57) ABSTRACT

A flexible zipper incorporating a layer of gas-impermeable thermoplastic material in one or both flanges. The zipper is installed in the mouth of a reclosable package or bag made of gas-impermeable material shaped to form a receptacle. The gas-impermeable web material of the receptacle and the layer of gas-impermeable material of the zipper form a substantially gastight enclosure for preserving the perishable contents of the package. Flexible zippers having a layer of gas-impermeable thermoplastic material joined to a layer of gas-permeable thermoplastic material are preferably manufactured by a coextrusion process. The resulting gas barrier inside the receptacle has a zone of preferential tearing.

5 Claims, 5 Drawing Sheets

RECLOSABLE PACKAGING WITH GAS BARRIER INCORPORATED IN ZIPPER

BACKGROUND OF THE INVENTION

The present invention relates to reclosable packaging and in particular to such packaging having an interior volume that is impermeable to gas, thereby protecting perishable contents from spoilage. Typically, the package has a slider-operated zipper or has pull flanges above the interlocking elements of the zipper.

In the use of plastic bags and packages, particularly for foodstuffs, it is important that the bag be hermetically sealed until the purchaser acquires the bag and its contents, takes them home, and opens the bag or package for the first time. It is then commercially attractive and useful for the consumer that the bag or package be reclosable so that its contents may be protected. Flexible plastic zippers have proven to be excellent for reclosable bags, because they may be manufactured with high-speed equipment and are reliable for repeated reuse.

A typical zipper is one that has a groove at one side of the bag mouth and a rib at the other side, which rib interlocks into the groove when the sides of the mouth of the bag are pressed together. Alternatively, a member having a plurality of ribs may be on one side of the bag mouth, while a member having a plurality of channels may be on the other side, the ribs locking into the respective channels when the sides of the mouth of the bag are pressed together. In such a case, there may be no difference in appearance between the two members, as the ribs may simply be the intervals between channels on a strip that may lock into another of the same kind. In general, and in short, some form of male/female interengagement is used to join the two sides of the bag mouth together. The so-called members, or strips, are bonded in some manner to the material from which the bags themselves are manufactured. Usually, pull flanges extend above the rib and groove strips, which pull flanges may be pulled apart for access to the interior of the bag.

Although flexible zippers of this variety are quite popular, they do not always prevent the admission of ambient air into the interior volume of the package. In particular, ambient air can enter the interior volume of the package via the interstices of the interlocked profiled fastener strips or zipper halves (hereinafter "profiled interlocking members"), which usually do not form a hermetic seal. In the event that a tamper-evident easy-open gas-permeable membrane is incorporated below the zipper, this also will not hermetically seal the interior volume of the package. The presence of gases such as oxygen, nitrogen and carbon dioxide inside the package is undesirable, especially when the contents of the package are perishable. It is known in the prior art to provide a zipper flange comprising gas-impermeable material for hermetically sealing the package. There is a need for a hermetically sealed zippered package that can be readily torn open by the consumer. Such zippered package designs should also allow the package to be formed on conventional packaging equipment with little or no modification of the equipment being required.

BRIEF DESCRIPTION OF THE INVENTION

The present invention is directed to a flexible zipper comprising gas-impermeable thermoplastic material, preferably incorporated in one or both flanges of the zipper. The invention is further directed to a reclosable package comprising gas-impermeable web material shaped to form a receptacle and a zipper comprising a layer of gas-impermeable material. The gas-impermeable web material of the receptacle and the layer of gas-impermeable material of the zipper form a substantially gastight enclosure for preserving perishable contents packaged therein.

In accordance with one embodiment, a flexible zipper comprises first and second profiled interlocking members and first and second flanges respectively joined to the first and second profiled interlocking members, wherein one flange or both flanges comprise a material that is gas impermeable. Preferably, one or both flanges has a layered structure comprising a layer made of a gas-permeable material and a layer made of said gas-impermeable material. In one embodiment in which only one flange has this layered structure, that flange includes a thinned area where the layer of gas-permeable material is absent. In another embodiment in which both flanges have the aforementioned layered structure, a gap between opposing edges of the gas-impermeable layers of the flanges is spanned by a membrane made of the same gas-impermeable material, the layers and membrane of gas-impermeable material forming a continuous gas barrier. The membrane has a thickness less than the thickness of the layered structures and thin enough to facilitate easy tearing by a consumer when the zipper is incorporated in a package. In accordance with the embodiments, this thinned tear zone made of gas-impermeable material extends in a longitudinal direction of the zipper.

In accordance with further embodiments of the invention, a reclosable package comprises a gas-impermeable web material defining a receptacle having a mouth at an upper end and a flexible zipper attached to the web material at the mouth, the zipper having one of the structures described above. The zipper comprises a continuous layer of gas-impermeable material that, when the zipper is installed in the package, serves as a gas barrier to protect perishable contents inside the package. In accordance with one embodiment, a single zipper flange acts as the gas barrier. In accordance with another embodiment, two flanges in combination with a connecting membrane act as the gas barrier.

In accordance with another aspect of the invention, methods of manufacturing the zippers disclosed herein involve coextrusion of gas-permeable and gas-impermeable thermoplastic materials. Alternatively, a zipper with gas-permeable and gas-impermeable layers can be formed by lamination. The preferred gas-permeable thermoplastics are polyethylene and polypropylene; the preferred gas-impermeable thermoplastics are nylon, polyester, polyvinyl dichloride and ethylene vinyl alcohol.

In cases of coextrusion of gas-permeable and gas-impermeable thermoplastic materials, the thinned area in a zipper flange (or the membrane connecting two zipper flanges) can be formed by shaping the extrusion die. The die orifice may be formed with a constriction where a thinned area is to be formed. The resulting thinned area will have a gas-impermeable layer and a gas-permeable layer. Optionally, gas-permeable layers can be coextruded on both sides of the gas-impermeable layer.

Other aspects of the invention are disclosed and claimed below.

DETAILED DESCRIPTION OF THE INVENTION

Figure 1:
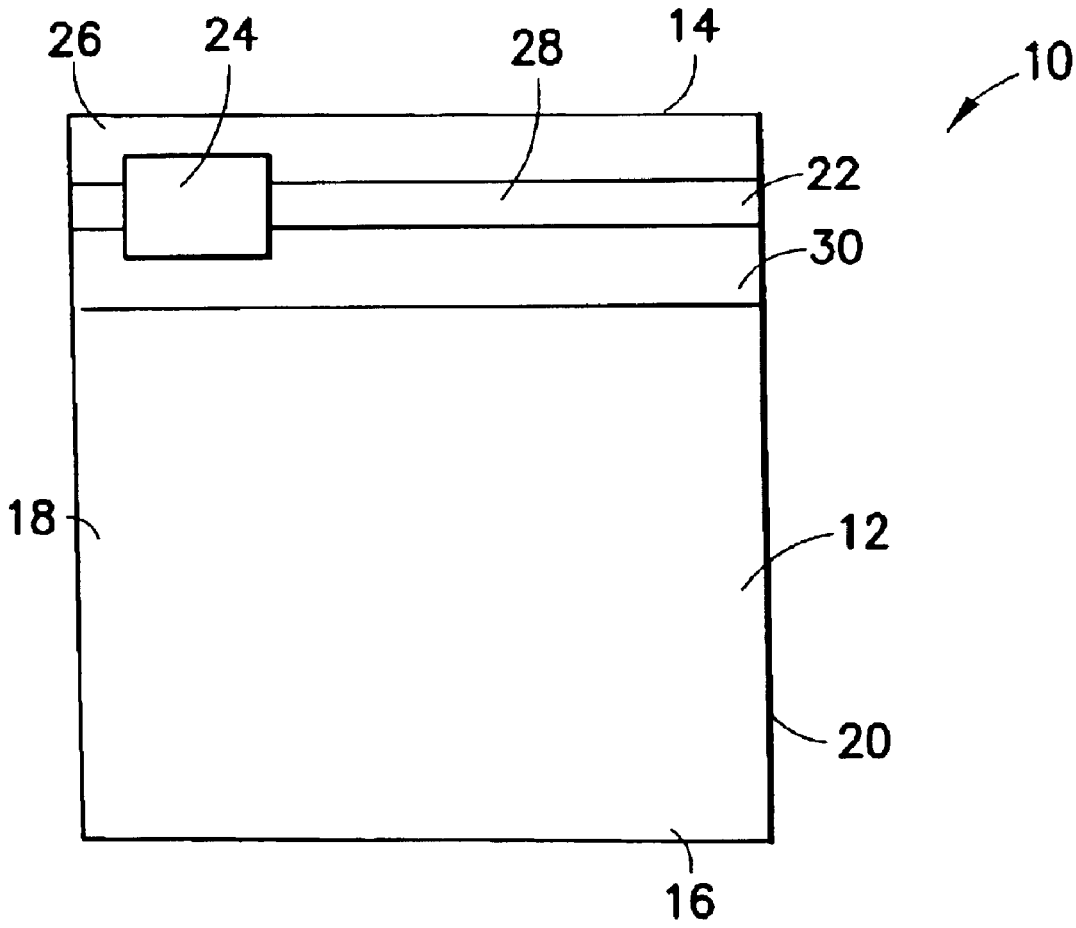
FIG. 1 is a drawing showing a front view of a typical reclosable package having a slider/zipper assembly.

Reference will now be made to the drawings in which similar members in different drawings bear the same reference numerals. FIG. 1 depicts a reclosable package or bag 10 comprising a front body panel or wall 12 and a rear body panel or wall (not visible in FIG. 1) behind and opposite the front wall 12. The package further has a top 14, a bottom 16, and left and right sides 18, 20. In one type of package, the bottom 16 comprises a fold in the web material forming the front and rear panels and sides 18, 20 each comprise a side seal formed in the overlapping edges of the front and rear panels. In another type of package, the bottom 16 comprises a bottom panel contiguous with the front and rear panels and sides 18, 20 each comprise a side seal as previously described. The front, rear and bottom panels preferably comprise laminations of thermoplastic materials, the lamination being formed as a web or film. The preferred thermoplastic materials are polyethylene or polypropylene laminated to a barrier layer consisting of gas-impermeable thermoplastic material. The side-sealed front and rear panels and the bottom 16 form a receptacle or pouch. The side-sealed uppermost portions of the front and rear body panels form a mouth of the receptacle. A zipper 22 is attached to the mouth of the receptacle to form a reclosable package. The reclosable package shown in FIG. 1 further comprises a header 26 encompassing the zipper. The header may be a panel or strip formed from the same material as that comprising the walls of the package or from the same material as that comprising the zipper or from an entirely separate material. The header 26 encloses the mouth of the receptacle and acts as a tamper-evident feature.

The thermoplastic web material of the front panel 12 and of the header 26 may be optically transparent, in which case a flexible zipper 22 and a slider 24, located inside of the package 10, will be visible, as seen in FIG. 1. Alternatively, web material of the body panels and the header may be opaque, in which case the header is advantageously provided with an opening through which a portion of the slider protrudes, thereby allowing a consumer to observe the desirable slider feature.

Typically the zipper 22 comprises two zipper halves that are heat-fused or bonded to the front and rear body panels respectively. Typically, one zipper half comprises an interlocking member (designated by numeral 28 in FIG. 1) having a male profile and the other zipper half comprises an interlocking member (not shown in FIG. 1) having a female profile designed to receive and interlock with the male interlocking member. Each zipper half also comprises a flange or fin joined to the respective interlocking member. The flange 30 of one zipper half is sealed to the front body panel and the flange of the other zipper half (not shown in FIG. 1) is sealed to the rear panel.

The packaging depicted in FIG. 1 includes a slider 24 mounted on the zipper 22 to facilitate its opening and closing. To this end, moving the zipper slider toward one side disengages the profiled interlocking members of the zipper halves and moving the slider toward the opposite side brings the interlockable members of the zipper halves into engagement.

Figure 2:
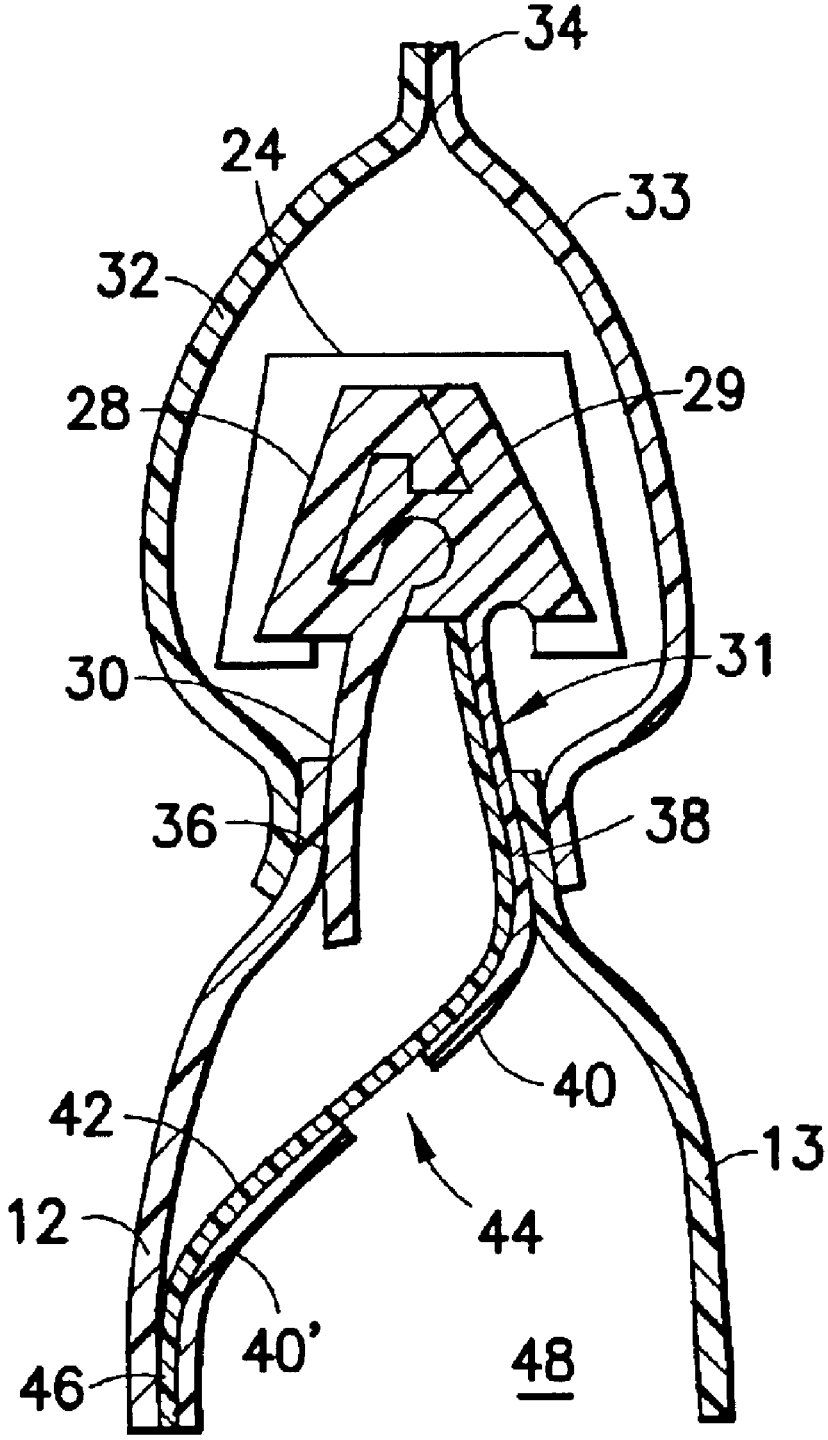
FIG. 2 is a drawing showing a fragmentary sectional view of the zippered portion of a reclosable package in accordance with a first embodiment of the invention.
Figure 3:
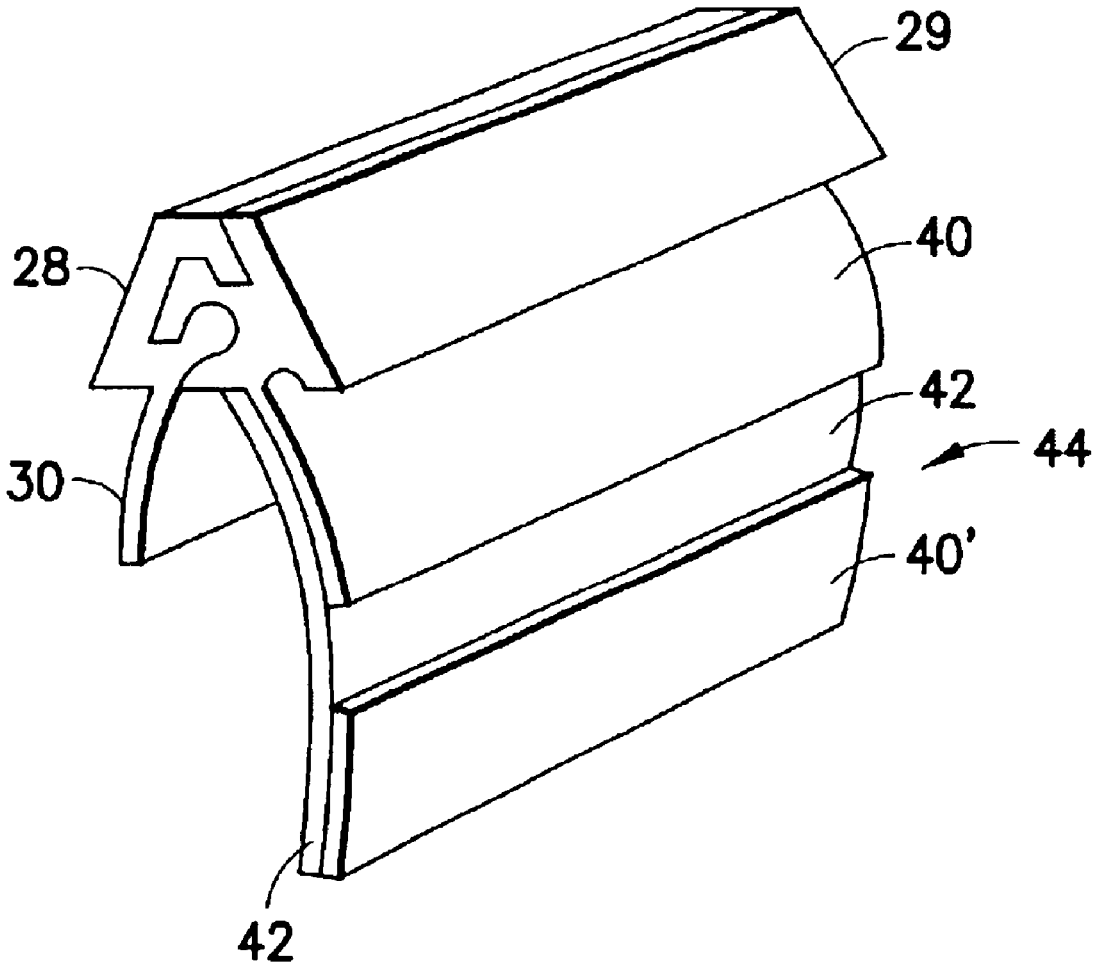
FIG. 3 is a drawing showing an isometric view of the zipper incorporated in the reclosable packaging depicted in FIG. 2.

The upper portion of a hermetically sealed reclosable package in accordance with one embodiment of the invention is depicted schematically in FIG. 2, while the zipper incorporated in the package of FIG. 2 is separately depicted in the isometric view seen in FIG. 3. Referring to FIG. 2, the front and rear panels of the receptacle are respectively designated by numerals 12 and 13, Front and rear panels of a header are respectively designated by numerals 32 and 33. The header panels 32 and 33 are sealed at their top edges by a hard seal 34. The bottom edge of front header panel 32 is heat-fused to a top portion of front body panel 12 at a hard seal 36. Hard seal 36 also bonds the top portion of front body panel 12 to the flange 30 of the interlocking member 28, which in this example has a female profile. The bottom edge of rear header panel 33 is heat-fused to a top portion of rear body panel 13 at a hard seal 38. Hard seal 38 also bonds the top portion of rear body panel 13 to a flange 31 of an interlocking member 29, which in this example has a male profile that interlocks with the female profile of interlocking member 28. Alternatively, bag walls 12 and 13 may extend up over the zipper profile and slider and be joined at a top seal 34 or fold.

In accordance with the embodiment depicted in FIGS. 2 and 3, the flange 31 has a length greater than the length of flange 30 and has a layered structure comprising a layer 40 of gas-permeable thermoplastic material and a layer 42 of gas-impermeable thermoplastic material. The preferred gas-impermeable thermoplastic materials are nylon, polyethylene terephthalate (polyester), ethylene vinyl alcohol and polyvinyl dichloride.

In accordance with a further advantageous feature, the layered flange 31 has a thinned zone 44 extending in the longitudinal direction of the zipper. In that thinned zone 44, the layered flange 31 may or may not have a layer of gas-permeable thermoplastic material. As an example, FIG. 2 depicts a thinned area 44 that does not have a layer of gas-permeable thermoplastic material. This thinned area is sufficiently thin that a consumer can readily obtain access to the sealed interior of the package by tearing the thin membrane that spans and forms the thinned area.

Preferably, the package depicted in FIG. 2 is manufactured using conventional extrusion and heat fusing (heat sealing) techniques. In particular, the zipper is preferably manufactured by coextrusion and then heat fused to the package web or film material. Preferably, the profiled interlocking members 28, 29, flange 30, and layer 40, all made of gas-permeable thermoplastic material, and layer 42, made of gas-impermeable thermoplastic material, are coextruded through a die plate fed by a plurality of extruders. These extruders carry the different molten materials for forming the flanges and the profiled interlocking members. As is well-known in the art, the die plate includes input ports, output ports, and channels connecting the input ports to the output ports. The extruders feed the different molten materials to different input ports, and the channels are designed to configure the molten materials into the shapes of the strips profiled interlocking members and the associated flanges. For example, the die plate may have a first output port for forming the zipper half consisting of interlocking member 28 and flange 30; a second output port for forming the portion of the second zipper half consisting of interlocking member 29 and layer 40; a third output port for forming the portion of the second zipper half consisting of layer 40'; and a fourth output port for forming the portion of the second zipper half consisting of layer 42. The output ports are arranged such that the interlocking members and layers exit the die plate with the connections shown in FIG. 3. Since the zipper halves are separate elements, it should be apparent that these two separate elements may, alternatively, be formed in separate extrusions using two different die plates.

After extruding the zipper halves or strips, the top portions of the front and rear body panels 12 and 13 are heat-fused to the flanges 30 and 31 respectively using heated seal bars, forming the hard seals 36 and 38 shown in FIG. 1. In particular, the front body panel 12 is heat-fused to the flange 30 and the rear body panel 13 is heat-fused to the flange 31 at the illustrated positions. The vertical dimension of the heat-fused portions is determined by the width of the seal bars applying pressure to the front and rear body panels 12, 13. As previously mentioned, in cases where a header is included, portions of the header are also heat-fused at the hard seal positions, as seen in FIG. 2. Again the header can be formed as an extension of the front and rear bag walls.

Referring to FIG. 2, the flange 31 has a length sufficient to allow the interrupted distal portion of the flange 31 to be heat-fused to the front body panel 12 at a hard seal 46. The side edges of the flanges 30 and 31 are preferably captured in the side seals (not shown in FIG. 2) of the package. In addition, the layer 42 of gas-impermeable thermoplastic material is continuous from the hard seal 38 to the hard seal 46. Thus, in accordance with the embodiment depicted in FIG. 2, the flange 31 serves as a gas-impermeable barrier to block the admission of ambient air into the interior volume 48 of the unopened package.

It will be readily apparent to persons skilled in the art that the structure depicted in FIG. 2 can be varied in numerous respects while still providing a gas barrier zipper flange that seals the gas-impermeable receptacle. For example, instead of welding the flange 31 to the front and rear body panels 12 and 13 using hard seals, an adhesive agent or a bonding strip could be placed between the flange and the opposing body panel. The header panels can be peel sealed together, with panel portions extending beyond the peel seal for easy grasping to separate the peel seal. It should also be appreciated that the header is optional and is not necessary to practice of the present invention. However, if a header is present, then the header can be formed as extensions of the front and rear body panels instead of as separate panels welded or sealed to the front and rear body panels. Also, the two separate panels could be replaced by a single folded panel joined at opposing ends to the front and rear body panels. Furthermore, it should be appreciated that a slider is not necessary to practice of the present invention. Thus, the header and/or the slider could be deleted from FIG. 2 to represent variations of the embodiment shown therein. If no header is provided, then the gas barrier flange having a thinned zone also serves as a tamper-evident feature, since a torn membrane in the gas barrier is readily visible to a consumer when the zipper is opened. The foregoing variations are also applicable to the embodiments depicted in FIGS. 4 and 5, described in detail below.

Figure 4:
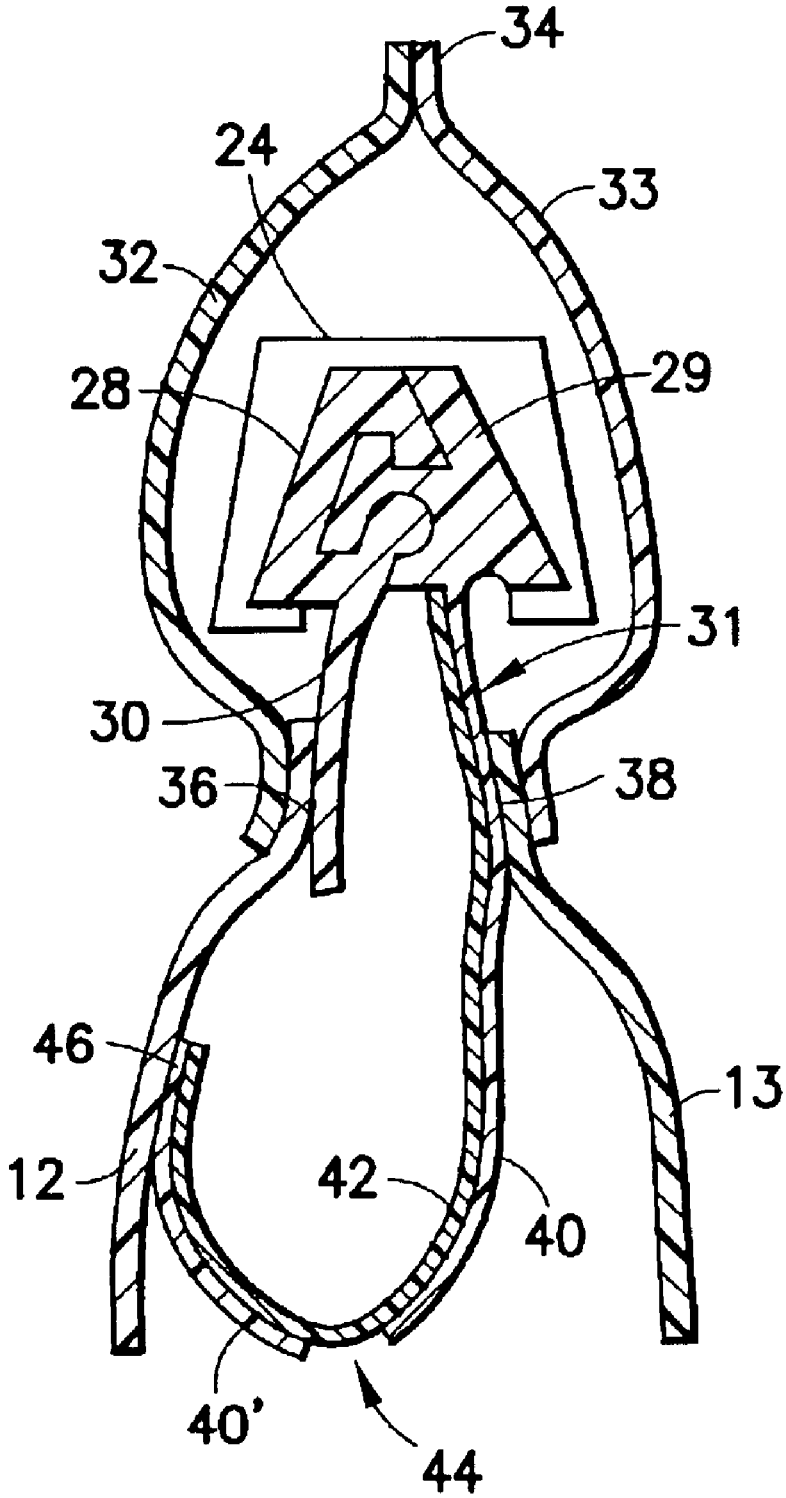
FIG. 4 is a drawing showing a fragmentary sectional view of the zippered portion of a reclosable package in accordance with a second embodiment of the invention.

FIG. 4 shows an alternative embodiment that differs from the embodiment shown in FIG. 2 only in that the distal portion of the gas barrier flange 31 is folded upward to form a J-shape. This has the effect that the layer 40 of gas-permeable thermoplastic material, not the layer 42 of gas-impermeable thermoplastic material, is in contact with the front body panel 12 at the hard seal 46.

Figure 5:
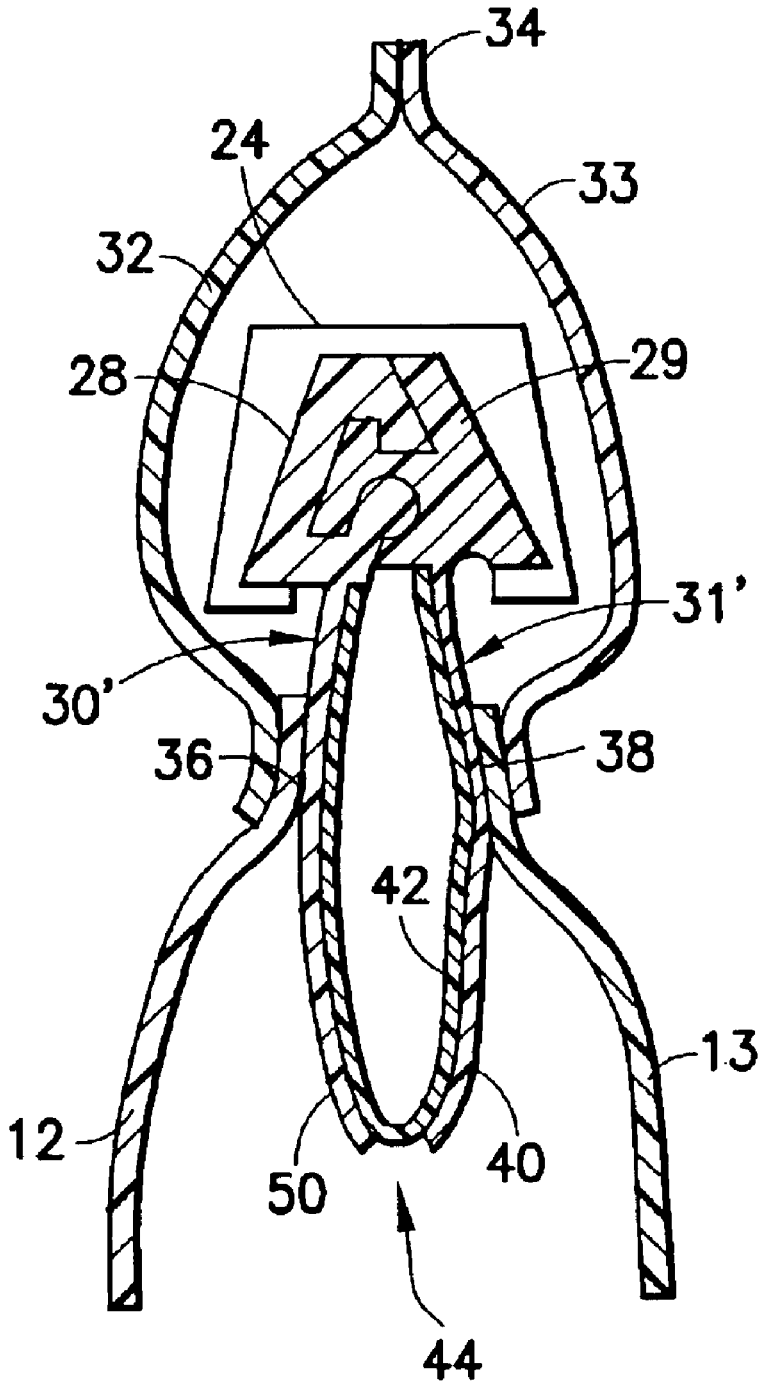
FIG. 5 is a drawing showing a fragmentary sectional view of the zippered portion of a reclosable package in accordance with a third embodiment of the invention.

A further embodiment of the invention is depicted in FIG. 5. This embodiment differs from the embodiment of FIG. 2 in several respects. First, both flanges of the zipper are layered, one layer in each flange being gas-impermeable thermoplastic material. More specifically, flange 30' comprises a layer 50 of gas-permeable thermoplastic material joined to a layer 42 of gas-impermeable thermoplastic material, while flange 31' comprises a layer 40 of gas-permeable thermoplastic material joined to a layer 42 of gas-impermeable thermoplastic material. In contrast, in the embodiment of FIG. 2, only one flange had a layer of gas-impermeable thermoplastic material. Second, the flanges 30', 31' are preferably of generally equal length. And third, the flanges 30', 31' are connected by a thin membrane 42 of gas-impermeable thermoplastic material which spans a gap between the distal edges of the flanges, forming a thinned area 44 that can be easily torn by the consumer. It should be appreciated that the layer 42 of gas-impermeable thermoplastic material preferably extends continuously from the hard seal 36 to the hard seal 38 and from side seal to side seal (the side seals are not shown in FIG. 5), thereby serving as a gas barrier that prevents the admission of ambient air into the interior volume of the package.

The zipper depicted in FIG. 5 is preferably manufactured by coextrusion and then heat fused to the package web or film material. Preferably, the profiled interlocking members 28, 29, and layers 40 and 50, all made of gas-permeable thermoplastic material, and layer 42, made of gas-impermeable thermoplastic material, are coextruded through a die plate fed by a plurality of extruders, in the manner previously described. For example, the die plate may have a first output port for forming the interlocking member 28 and layer 50 of gas-permeable thermoplastic material; a second output port for forming the interlocking member 29 and layer 40 of gas-permeable thermoplastic material; and a third output port for forming the layer 42 of gas-impermeable thermoplastic material. The output ports are arranged such that the interlocking members and layers exit the die plate with the connections shown in FIG. 5. Since the zipper halves are connected by the thin membrane of gas-impermeable material, it should be apparent that the zipper is best formed in a single coextrusion using one die plate.

Although the preferred method of manufacture involves coextrusion, it will be readily apparent to persons skilled in the art that the zippers disclosed herein could also be manufactured by laminating the gas-impermeable barrier to a flange layer or both flange layers made of gas-permeable material.

In accordance with further embodiments of the invention, the thinned zone for easy tearing could be formed as a layered structure comprising a layer of gas-permeable thermoplastic material joined to a layer of gas-impermeable thermoplastic material provided that the total thickness of the layered structure in the tear zone is less than the thickness elsewhere. For example, in a variation of the embodiment depicted in FIG. 2, the layers 40 of gas-permeable material incorporated in flange 31 could be continuous instead of discontinuous, provided that the thickness of flange 31 in the tear zone is less than the thickness of the flange elsewhere. Similarly, the layered flanges 30' and 31' shown in FIG. 5 could be connected by a layered membrane comprising layers of gas-permeable and gas-impermeable thermoplastic materials, provided that the membrane has a thickness less than the thickness of the flanges. This can be accomplished by shaping the extrusion die to have a constriction where the thinned area is desired. The thinned area comprises gas-permeable and gas-impermeable layers.

In accordance with yet other embodiments of the invention, the tear zone could be formed as a layered structure of the same thickness, except that the layer of gas-permeable thermoplastic material has a line of perforations or a line of weakness (other than a line of weakness formed by thinning) therein. For example, in a case where the layer of gas-permeable material is laminated to a layer of gas-impermeable material, the layer of gas-permeable material could be perforated along a line before it is laminated to the layer of gas-impermeable material.

While the invention has been described with reference to embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "gas-impermeable thermoplastic material" means a material selected from the group consisting of nylon, polyester, polyvinyl dichloride, ethylene vinyl alcohol, and thermoplastic materials having the same gas barrier properties, while the term "gas-permeable thermoplastic material" means a material selected from the group of thermoplastic materials having a gas permeability greater than that of the above-defined gas-impermeable thermoplastic materials.

What is claimed is:

1. A reclosable package comprising:

a receptacle having an interior volume and a mouth, said receptacle comprising first and second walls joined to each other along first and second side seams of said receptacle; and a zipper comprising first and second profiled members that are mutually interlockable, and first and second flanges respectively connected at a respective end thereof to said first and second profiled members, said second flange being longer than said first flange, a portion of said first flange being joined to said first wall at or near said mouth, a first portion of said second flange being joined to said second wall at or near said mouth, and a second portion of said second flange being sealed to said first wall at an elevation below an elevation where said first flange is joined to said first wall, said interior volume of said receptacle being partitioned by said second flange, wherein said second flange comprises a first layer of gas-permeable thermoplastic material having one end connected to said first profiled member, a layer of gas-impermeable thermoplastic material comprising a first portion laminated to said layer of gas-permeable thermoplastic material and a second portion connected to said first portion and extending beyond a distal end of said layer of gas-permeable thermoplastic material, and a second layer of gas-permeable thermoplastic material laminated to said second portion of said layer of gas-impermeable thermoplastic material, said first and second layers of gas-permeable material being on the same side of said layer of gas-impermeable thermoplastic material and not in contact with or connected to each other, said first portion of said layer of gas-impermeable thermoplastic material extending from said distal end of said first layer of gas-permeable thermoplastic material to a region where said second flange is joined to said second wall, and said second portion of said layer of gas-impermeable thermoplastic material extending from said distal end of said of said first layer of gas-permeable thermoplastic material to a region where said second flange is joined to said first wall.

2. The package as recited in claim 1, further comprising a slider mounted to said zipper.

3. The package as recited in claim 2, further comprising a header covering said slider and said zipper.

4. The package as recited in claim 1, wherein said second portion of said layer of gas-impermeable thermoplastic material has a portion joined to said first wall.

5. The package as recited in claim 1, wherein said second layer of gas-permeable thermoplastic material has a portion joined to said first wall.

* * * * *